US009249715B2

(12) United States Patent
Ichihashi

(10) Patent No.: US 9,249,715 B2
(45) Date of Patent: Feb. 2, 2016

(54) AIR COOLED ENGINE AND ENGINE-POWERED WORK TOOL

(71) Applicant: HITACHI KOKI CO., LTD., Tokyo (JP)

(72) Inventor: Naoto Ichihashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 14/195,025

(22) Filed: Mar. 3, 2014

(65) Prior Publication Data

US 2014/0261255 A1 Sep. 18, 2014

(30) Foreign Application Priority Data

Mar. 18, 2013 (JP) ..... 2013-054837

(51) Int. Cl.

| | |
|---|---|
| ***F01P 1/06*** | (2006.01) |
| ***F01P 1/02*** | (2006.01) |
| ***F01P 5/06*** | (2006.01) |
| *F02B 63/02* | (2006.01) |

(52) U.S. Cl.

CPC ... *F01P 1/02* (2013.01); *F01P 5/06* (2013.01); *F01P 2001/026* (2013.01); *F02B 63/02* (2013.01)

(58) Field of Classification Search

CPC ..... F02B 63/02; F01P 1/02; F01P 5/06; F01P 2001/026

USPC ..... 123/41.34, 41.56, 41.58, 41.61

See application file for complete search history.

(56) References Cited

U.S. PATENT DOCUMENTS

| | | | | |
|---|---|---|---|---|
| 4,494,490 | A * | 1/1985 | Kiyooka | F01P 5/02 123/195 C |
| 5,950,578 | A * | 9/1999 | Hirano | F01P 5/06 123/41.65 |
| 7,458,343 | B2 * | 12/2008 | Tanabe | F01P 11/00 123/41.69 |
| 2001/0029921 | A1 * | 10/2001 | Ito | F01M 1/04 123/196 R |
| 2013/0239914 | A1 * | 9/2013 | Ichihashi | F01P 1/00 123/41.56 |

FOREIGN PATENT DOCUMENTS

JP 3726065 B2 12/2005

* cited by examiner

*Primary Examiner* — Marguerite McMahon
*Assistant Examiner* — James Kim
(74) *Attorney, Agent, or Firm* — Kilpatrick Townsend & Stockton LLP

(57) ABSTRACT

An air-cooled engine includes a cylinder provided with a plurality of cooling fins at an outer peripheral surface of the cylinder, a cooling fan, a cylinder cover covering the cylinder, an air guide plate, and an air guide portion. The air guide plate is positioned between an inner surface of the cylinder cover and the fins. The cooling fan generates cooling air stream for cooling the cylinder, and the air guide plate is configured to guide the cooling air stream to flow through a space between the inner surface of the cylinder cover and the fins. A first small space is defined between the air guide plate and the inner surface of the cylinder cover. The air guide portion covers at least a part of the first small space at an upstream side of the air guide plate in the axial direction of the drive shaft.

12 Claims, 9 Drawing Sheets

PRIOR ART

AIR COOLED ENGINE AND ENGINE-POWERED WORK TOOL

CROSS REFERENCE TO RELATED APPLICATION

This application claims priority from Japanese Patent Application No. 2013-054837 filed Mar. 18, 2013, the entire content of which is incorporated herein by reference.

TECHNICAL FIELD

The present invention relates to a compact air cooled engine, and to a work tool provided with the engine.

BACKGROUND

A compact engine is employed as a power source in an electric generator and a portable work tool such as a grass-trimmer, a blower, a chain-saw, and a power cutter. FIG. 9 shows a conventional grass-trimmer 300 as a typical example of the work tool. The grass-trimmer 300 has a right end portion provided with a main body 310 in which an engine is accommodated, a left end portion provided with a cutting blade 320, and an intermediate portion provided with a handle 330. Rotation of the engine is transmitted to the cutting blade 320, so that the rotating cutting blade 320 performs cutting to a plant, or trimming to a hedge while an operator grips the handle 330.

An air cooled engine is widely used for the work tool because of the need for a compact and light-weight engine. In the air cooled engine, a cooling fan is fixed to a drive shaft of the engine, and the fan is continuously rotated during engine operation for generating a cooling air to forcibly cool an engine component such as a cylinder. The cylinder of the air-cooled engine is generally cylindrical and has an inner side in which a combustion chamber is defined, and has an outer side provided with a plurality of heat radiation fins for enhancing cooling efficiency to the cylinder. Heat dissipation can be efficiently performed when the cooling air passes through a space between the neighboring fins, thereby efficiently performing cooling to the cylinder.

In order to secure safety for the operator, the cooling fan and the cylinder which is operated at a high temperature are covered with a cover made of a resin. A cover portion covering the cylinder (cylinder cover) is configured to allow the cooling air generated at the cooling fan to flow through the cooling fins for efficient cooling to the cylinder. However, size and shape of the cylinder cover is subjected to restriction so as to install the engine in its entirety to the work tool.

On the other hand, melting may occur in the cylinder cover having a low heat resistivity if an inner surface of the cylinder cover is in contact with the cylinder or fins. Further, the cylinder and the cylinder cover involve dimensional tolerance and positioning tolerance. When a narrow gap between the cylinder and the cylinder cover is contemplated, various problems may occur from the practical perspective such as: the cylinder and the cylinder cover are in continuous contact with each other due to dimensional error; or these may be contacted with each other due to engine vibration; or intensive vibration occurs in the cylinder cover even though contact between the cylinder and the cylinder cover is avoided. Taking the above in mind, a gap between the cylinder and the cylinder cover should be set as narrow as possible yet allowing cooling air to flow through the gap but avoiding such above-described drawbacks.

However, high cooling efficiency may not be attainable in case that cooling air flows through such narrow gap. To overcome this problem, Japanese Patent No. 3726065 discloses an air guide plate provided between the cylinder cover and the cylinder. The air guide plate can efficiently flow cooling air particularly along the cylinder region, thereby providing high cooling efficiency. The air guide plate extends in a direction parallel to the inner surface of the cylinder cover.

SUMMARY

Still however, in case the air guide plate extends in parallel to the inner surface of the cylinder cover, cooling air flows not only through a space between the air guide plate and the cylinder, but also through a space between the air guide plate and the cylinder cover. The cooling air flowing through the latter space does not contribute to the cooling to the cylinder, but only the cooling air flowing through the former space contributes directly to the cooling.

Thus, the inventor found that sufficient cooling to the cylinder may not be achievable in spite of the air guide plate provided in an internal space of the cylinder cover.

In view of the foregoing, it is an object of the present invention to provide a compact air cooled engine and a work tool provided with the engine capable of overcoming the above-described problems.

In order to attain the above and other objects, the invention provides an air-cooled engine including: an engine body; a drive shaft provided with a cooling fan and defining an axis extending in an axial direction; a cylinder cover; and an air guide plate. The engine body includes a cylinder having a cylinder portion and a plurality of cooling fins provided at an outer peripheral surface of the cylinder portion. The cylinder cover covers the cylinder. The air guide plate is provided at an internal space of the cylinder cover and between an inner surface of the cylinder cover and the plurality of fins, the cooling fan being configured to generate cooling air stream within the cylinder cover for cooling the cylinder, and the air guide plate being configured to guide the cooling air stream to flow through a space between the inner surface of the cylinder cover and the plurality of fins, a first small space being defined between the air guide plate and the inner surface of the cylinder cover. The air-cooled engine is characterized by an air guide portion provided in the internal space of the cylinder cover and configured to cover at least a part of the first small space at an upstream side of the air guide plate in the axial direction of the drive shaft.

Preferably, the air guide portion is configured to fully cover the first small space at the upstream side of the air guide plate in the axial direction of the drive shaft.

Preferably, the air guide portion is positioned to be spaced away from an upstream end of the air guide plate by a length ranging from 1 mm to 2 mm in the axial direction of the drive shaft.

Preferably, the air guide portion protrudes from the inner surface of the cylinder cover toward the cylinder.

Preferably, the air guide portion is positioned downstream of an upstream end portion of the cylinder in the axial direction of the drive shaft.

Preferably, the air guide plate and the plurality of cooling fins define a second small space therebetween; and the air guide portion covers the second small space at the upstream side of the air guide plate in the axial direction of the drive shaft.

Preferably, the air guide portion entirely covers the second small space when viewing from the upstream side of the air guide portion at the upstream side of the air guide plate in the axial direction of the drive shaft.

Preferably, the air guide portion is provided at the inner surface of the cylinder cover.

Preferably, the air guide portion is integral with the cylinder cover.

Preferably, the air guide portion constitutes a part of the air guide plate.

Preferably, the inner surface of the cylinder cover has a protrusion protruding toward the cylinder; and the air guide portion constitutes a part of the air guide plate and is engaged with the protrusion.

According to another aspect of the invention, there is provided an engine-operated work tool provided with the above-described air-cooled engine.

DETAILED DESCRIPTION

An air-cooled engine 100 according to one embodiment of the present invention will be described with reference to FIGS. 1 through 6. The "air-cooled engine" referred herein encompasses a two-cycle engine body having a cylinder and a crank case, and a cylinder cover covering the cylinder, etc. The engine body has a drive shaft to which a cooling fan is fixed. Rotation of the cooling fan generates cooling air for cooling the cylinder covered by the cylinder cover. The cylinder has an inner cylindrical space defining a combustion chamber and has an outer peripheral surface to which a plurality of radiation fins is provided.

Figure 9:
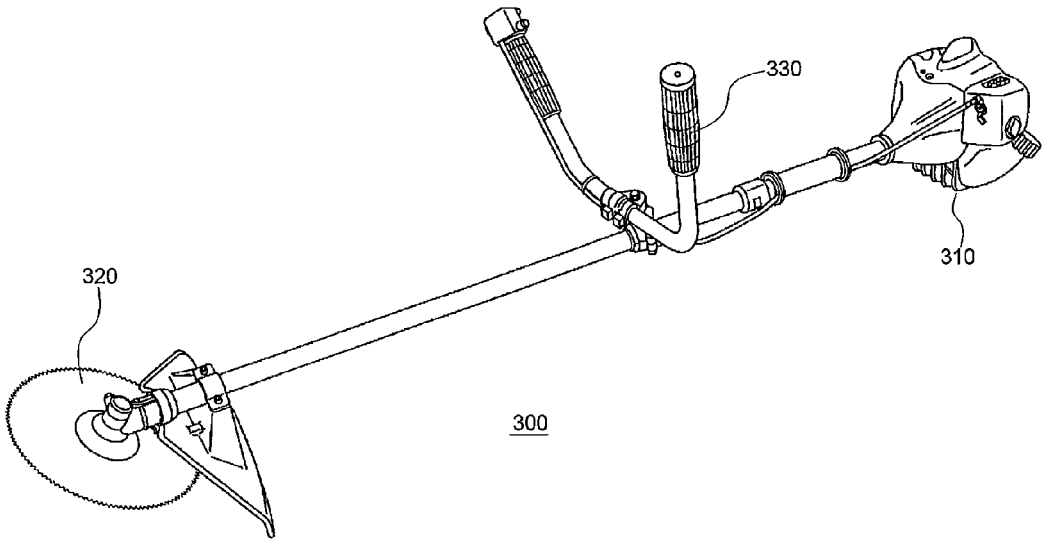
FIG. 9 is a perspective view of a conventional engine-powered work tool equipped with a compact air-cooled engine.

The air-cooled engine is used for a portable engine-powered work tool such as a grass-trimmer, a blower, a chain-saw, and a power cutter, or an electric generator, and the air-cooled engine is installed on a main body of the work tool. In reality, a decelerator for driving the main body of the work tool is connected to the drive shaft, and further, a structure for fixing the air-cooled engine to the main body of the work tool (for example, main body 310 of the grass-trimmer 300 shown in FIG. 9) is provided in the air-cooled engine. However, the connecting structure for connecting the engine to the main body of the work tool is conventional, and does not pertain directly to the present invention. Therefore, description for such structure will be omitted, and cooling structure and cooling function with respect to the engine will be described hereinafter.

Figure 1:
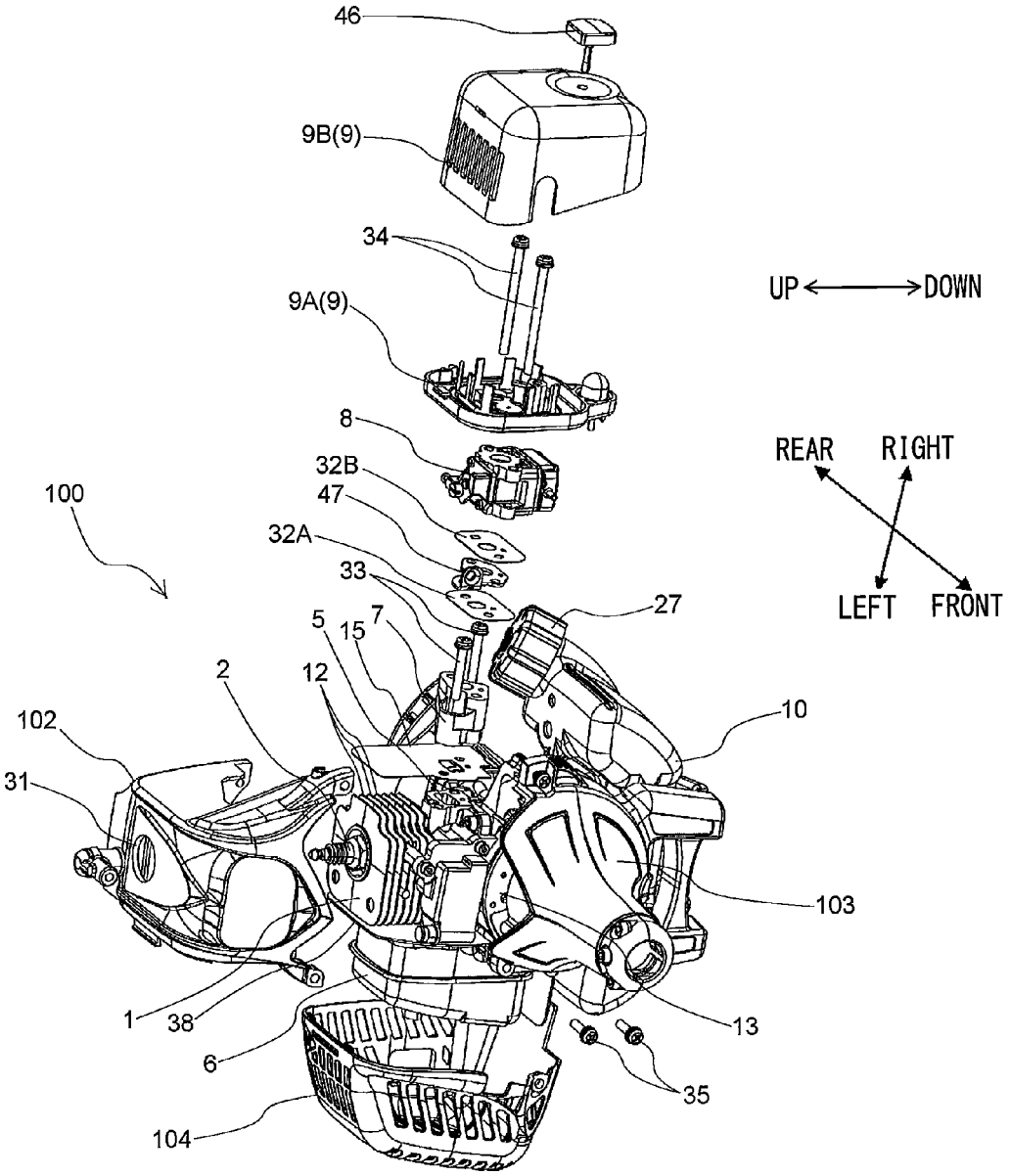
FIG. 1 is an exploded perspective view of an overall structure of an air-cooled engine according to one embodiment of the present invention.

The air-cooled engine 100 according to the present embodiment is shown in FIG. 1. In FIG. 1, a left side and a right side of FIG. 1 illustrate, respectively, "upper" side and "lower" side of the air-cooled engine 100, while a lower side and an upper side of FIG. 1 illustrate "left" side and "right" side of the air-cooled engine 100, respectively. Further, the orientation of "front" side and "rear" side of the air-cooled engine 100 in FIG. 1 are shown in FIG. 1.

The engine 100 includes a crank case 3A, 3B (not shown in FIG. 1) and a cylinder 1 vertically extending upward from the crank case 3A, 3B. The cylinder 1 has an internal space provided with a piston 21 (not shown in FIG. 1) and has an outer surface provided with a plurality of fins 12 arrayed in a vertical direction for enhancing cooling efficiency. In FIG. 1, a sleeve portion 17 (cylinder portion) of the cylinder 1 is not visible by the plurality of fins 12. The cylinder 1 has an upper portion provided with an ignition plug 2 for igniting air-fuel mixture in the cylinder 1. The engine 100 has a drive shaft 23 (not shown in FIG. 1) to which a cooling fan 13 is fixed for generating cooling air stream.

Figure 2:
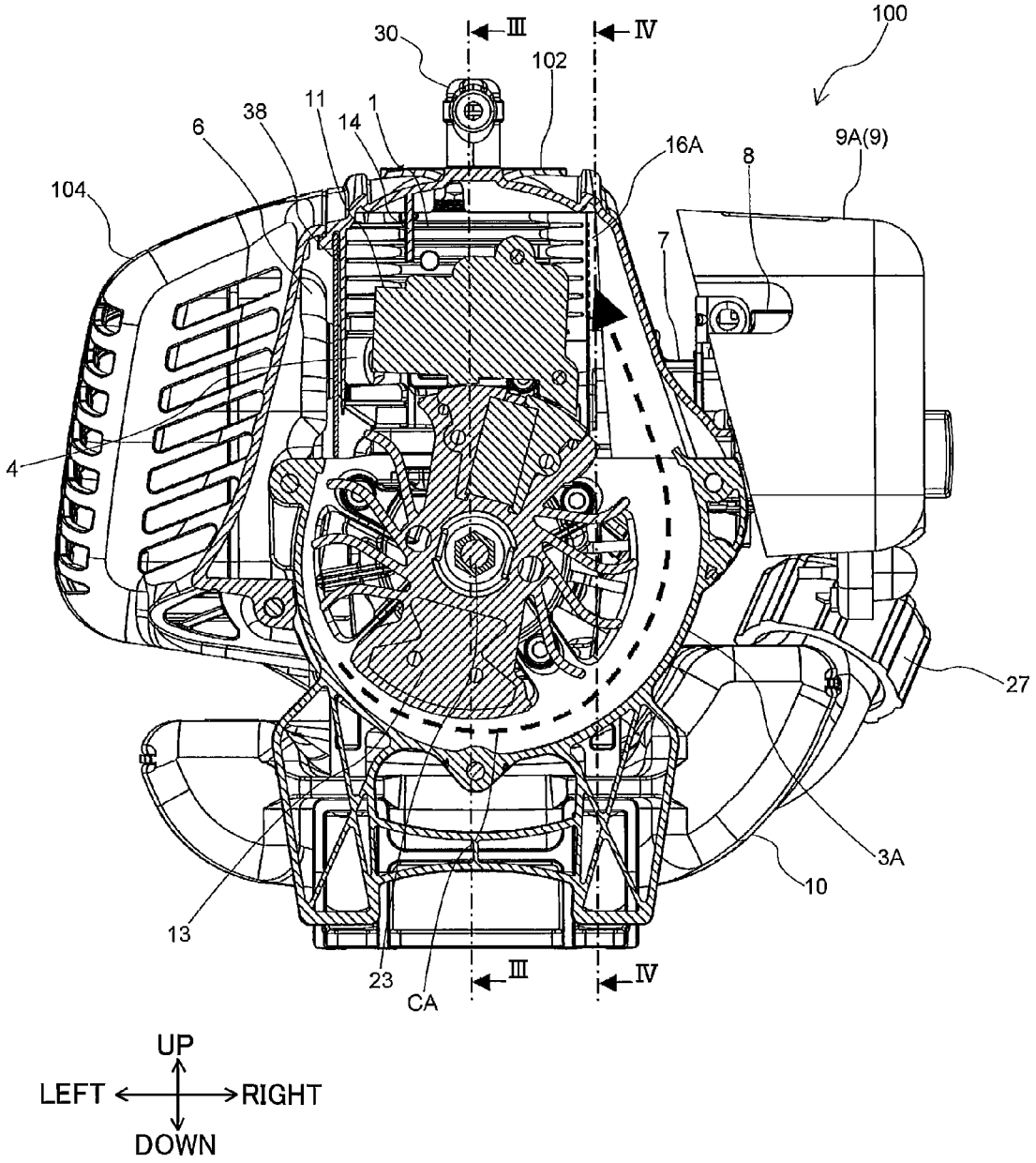
FIG. 2 is a cross-sectional view taken along a line II-II of FIG. 3.

In FIG. 1, the drive shaft 23 extends in a frontward/rearward direction, and the cooling fan 13 is fixed to the front side of the drive shaft 23. FIG. 2 is a cross-sectional view taken along a plane perpendicular to the drive shaft 23 as is apparent from the line II-II in FIG. 3.

As shown in FIGS. 1 and 2, a fuel tank 10 is provided at a lower side of the crank case 3A, 3B, and an air intake port 5 is formed at a right side of the cylinder 1 for introducing a mixture of air and fuel from the fuel tank 10 into the cylinder 1. An air guide plate 15 is positioned at right side of the intake port 5, and an intake tube 7 is fixed to the intake port 5 through the air guide plate 15 by male threads 33. The air guide plate 15 serves as a gasket between the intake port 5 and the intake tube 7. As shown in FIG. 1, the air guide plate 15 is flat plate shaped and largely extends in comparison with the intake port 5 and the intake tube 7. As described later, the extended portion of the air guide plate 15 can contribute to the cooling to the cylinder 1 with the cooling air.

A carburetor 8 for forming air-fuel mixture is positioned at right side of the intake tube 7 through a gasket 32A, a bracket 47 and a gasket 32B. Further, an air cleaner 9 for trapping dust contained in air to be introduced into the carburetor 8 is positioned at right side of the carburetor 8, and is fixed to an engine body 101 by male threads 34. The air cleaner 9 includes two cleaner cases 9A, 9B and a filter element (not shown) configured to trap the dust and positioned between the cleaner cases 9A and 9B. The cleaner cases 9A, 9B are fixed to each other by a knob 46. The carburetor 8 and the fuel tank 10 are communicated with each other through a fuel passage (not shown) for supplying fuel from the fuel tank 10 to the carburetor 8. Fuel can be filled into the fuel tank 10 through a filler neck capped with a filler cap 27.

An exhaust port 4 is formed at left side of the cylinder 1. A muffler 6 for purifying exhaust gas and sound deadening is connected to the exhaust port 4 through a partition plate 38. Thus, exhaust gas is released outside through the muffler 6. The partition plate 38 serves as a gasket between the muffler 6 and the exhaust port 4, and as shown in FIG. 1, the partition plate 38 is flat plate shaped and largely extends in comparison with the exhaust port 4. As described later, the extended portion of the partition plate 38 can contribute to the cooling to the cylinder 1 with the cooling air similar to the air guide plate 15.

During engine operation, temperature of the cylinder 1 and the muffler 6, etc. is elevated. To this effect, a cylinder cover 102 is fixed to the main body of the engine 100 by means of male threads (not shown). Further, a muffler cover 104 for covering the muffler 6 is fixed to the main body of the engine 100 by means of male threads 35. In this case, as shown in FIG. 2, the partition plate 38 is provided at a position between the exhaust port 4 and the muffler 6. As a result, the cylinder 1 is surrounded by the cylinder cover 102, the air guide plate 15, and the partition plate 38, so as to allow cooling air generated at the cooling fan 13 to flow through a space between the cylinder 1 and the surrounding components.

The cylinder cover 102 and the muffler cover 104 are molded products having a complex configuration. Since these covers 102, 104 are made from a resin, these covers 102, 104 provide low heat resistivity. In this connection, direct contact of these covers 102, 104 with the cylinder 1 heated at high temperature is avoided. On the other hand, since the air guide plate 15 and the partition plate 38 those having a simple flat plate shape serve as gaskets, these plates 15, 38 are made from a material having high heat resistivity and sealing ability similar to the gaskets 32A, 32B. Therefore, these plates 15, 38 are not thermally degraded due to the heat from the cylinder 1.

A fan case 103 is provided for accommodating the cooling fan 13 for efficient generation of the cooling air upon rotation of the fan 13. As shown in FIG. 1, the fan case 103 is volute shaped such that diameter of the fan case 103 is gradually increased toward the cylinder 1. An axis of the fan case 103 is coincident with an axis of the drive shaft 23. As shown in FIG. 2, cooling air stream CA is flowed from the right side of the cooling fan 13 to an upper portion of the cylinder 1, provided that the drive shaft 23 (or cooling fan 13) is rotated in a counterclockwise direction in FIG. 2.

Figure 3:
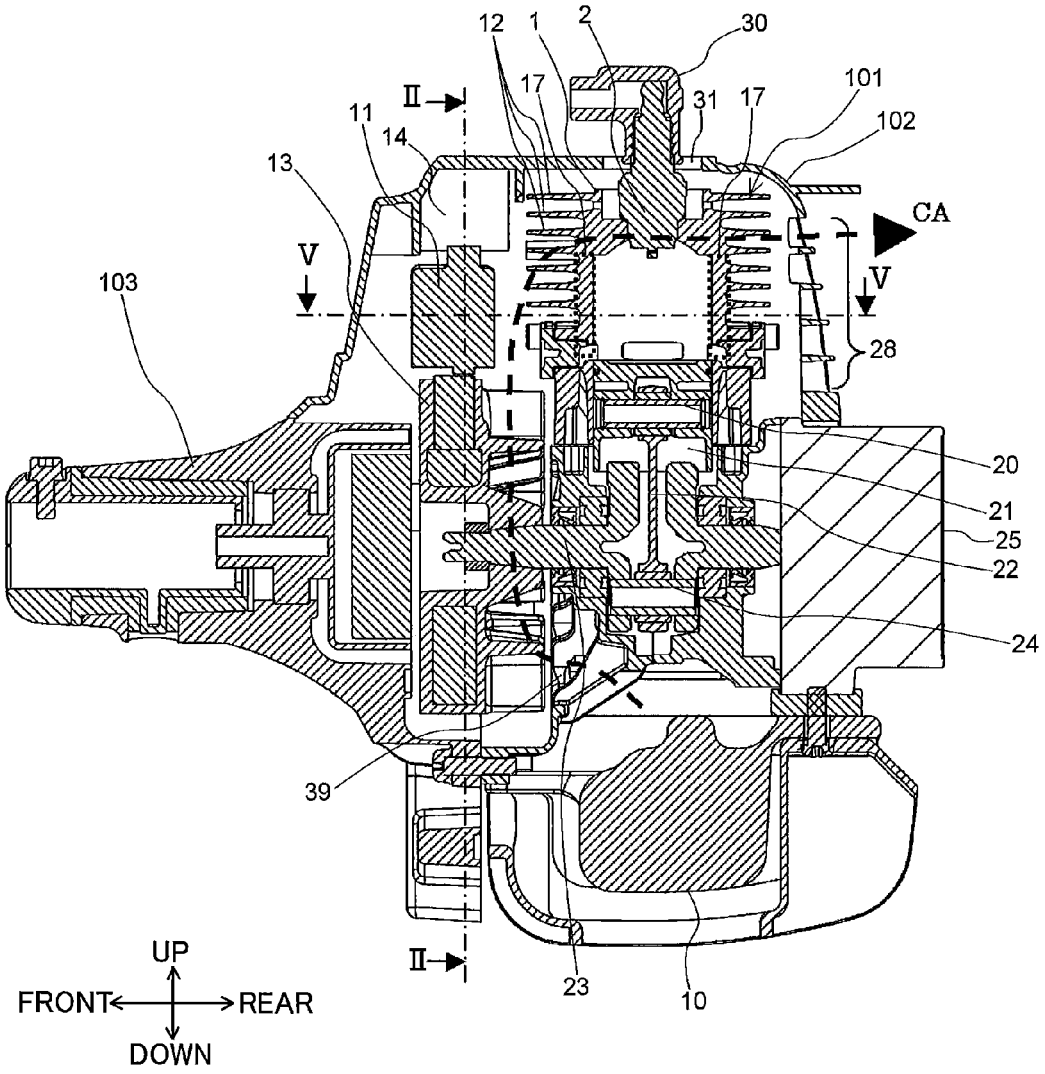
FIG. 3 is a cross-sectional view taken along a line of FIG. 2.

As shown in FIGS. 2 and 3, an air guide rib 14 is positioned forward of the cylinder 1 and extends in the frontward/rearward direction along the fan case 103 and the cylinder cover 102. The air guide rib 14 is of plate shaped and protrudes downward from and integral with at least one of inner surfaces of the fan case 103 and the cylinder cover 102. The air guide rib 14 is configured to face or receive the cooling air stream CA which is flowed around an ignition device 11 (see FIGS. 2 and 3) and is directed toward the exhaust port 4 (starting point of the volute shape) in a rotational direction of the cooling fan 13. Thus, the air guide rib 14 restrains the air stream CA from flowing toward the exhaust port 4 and guides the cooling air stream CA to flow toward the cylinder 1 as much as possible. With this structure, amount of cooling air stream CA which does not make available for cooling the cylinder 1 can be reduced, to thus secure sufficient amount of cooling air stream CA to be flowed to the cylinder 1.

To attain this effect as much as possible, the air guide rib 14 has a lower end positioned lower than an upper end of the ignition device 11 where attachment boss for attaching the ignition device 11 to the cylinder 1 is formed. In other words, the lower end of the guide rib 14 should be positioned closer to a bottom dead center in an axial direction of the cylinder 1 than the upper end of the ignition device 11 to the bottom dead center. With this structure, a labyrinth space can be provided around the ignition device 11 in cooperation with a side wall of the ignition device 11 and the air guide rib 14. Therefore, this labyrinth space can be a resistance against the cooling air stream CA flowing therethrough. Consequently, the labyrinth space prevents the cooling air stream CA from flowing thereinto.

Figure 4:
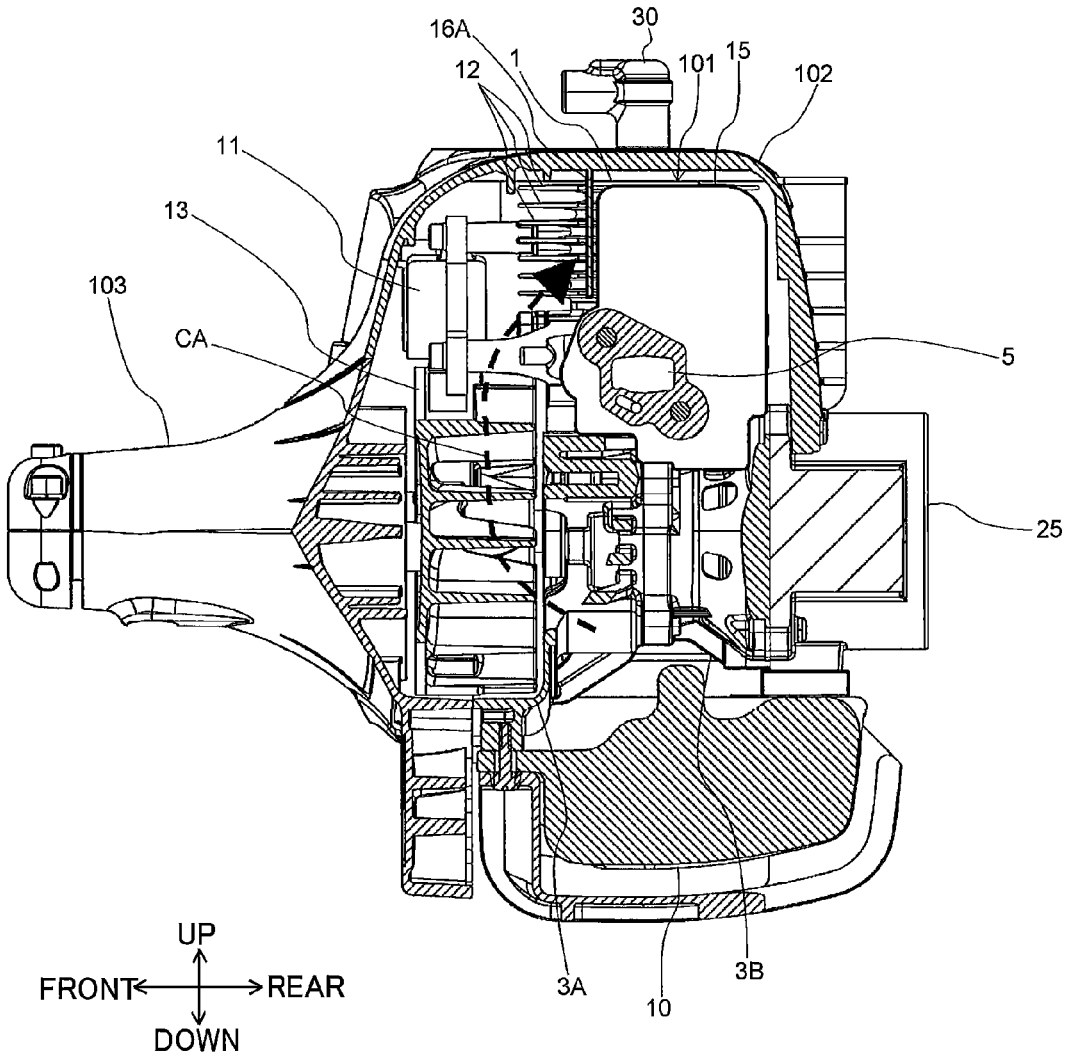
FIG. 4 is a cross-sectional view taken along a line IV-IV of FIG. 2.

FIG. 3 is a vertical cross-sectional view containing a cross-section of the drive shaft 23, and FIG. 4 is a vertical cross-sectional view beside the cross-section of FIG. 3. As shown in FIGS. 3 and 4, the fan case 103 is positioned at front side, and a starter 25 is positioned at rear side. FIGS. 3 and 4 show an internal structure of the engine body 101 including the cylinder 1 and the crank case 3A, 3B these connected to each other by male threads (not shown).

The cylinder 1 includes the generally cylindrical sleeve portion (cylinder portion) 17 having an outer peripheral portion at which a plurality of plate-like radiation fins 12 is arrayed in the vertical direction. The cylinder portion 17 has an internal space in which a piston 21 is provided. The internal space and the piston 21 define in combination a combustion chamber. Vertical reciprocating motion of the piston 21 is transmitted to a connection rod 22 via a piston pin 20, and is further transmitted to the drive shaft 23 from the connection rod 22 via a crank pin 24. With this structure, reciprocating motion of the piston 21 causes rotational motion of the drive shaft 23.

The ignition plug 2 has a lower end provided with an ignition portion disposed in the combustion chamber. Thus, air-fuel mixture compressed by the piston 21 in the combustion chamber is ignited. The ignition plug 2 has an upper end portion positioned above the cylinder 1, and a plug cap 30 is connected to the upper end portion for applying a high voltage to the ignition plug 2. High voltage is generated at the ignition device 11 provided at the peripheral surface of the cylinder 1 through a high voltage cord (not shown). Thus, the drive shaft 23 of the engine 100 is rotated.

In FIG. 3, the starter 25 having a starting handle (not shown) is provided rearward of the drive shaft 23. During shutdown of the engine 100, upon operating the starting handle by a user, the drive shaft 23 is forcibly rotated to start up the engine 100. The starter 25 is a conventional manual starter, which is operated only for a start-up operation, and independent of the engine operation after start-up.

In FIG. 3, the drive shaft 23 has a front end portion to which the cooling fan 13 is fixed. The cooling fan 13 is accommodated in a region surrounded by the crank case 3A and the fan case 103. The crank case 3A has an opening portion 39 through which air is introduced into the region by the rotation of the cooling fan 13 to generate the cooling air stream CA. In the space surrounded by the cylinder cover 102, the cooling air stream CA flows from the cooling fan 13 toward the cylinder 1 as shown in FIG. 3 for cooling the cylinder 1. Thereafter, the cooling air stream CA is flowed outside of the cylinder cover 102 through a ventilator window 28 formed at a rear portion of the cylinder cover 102.

Figure 5:
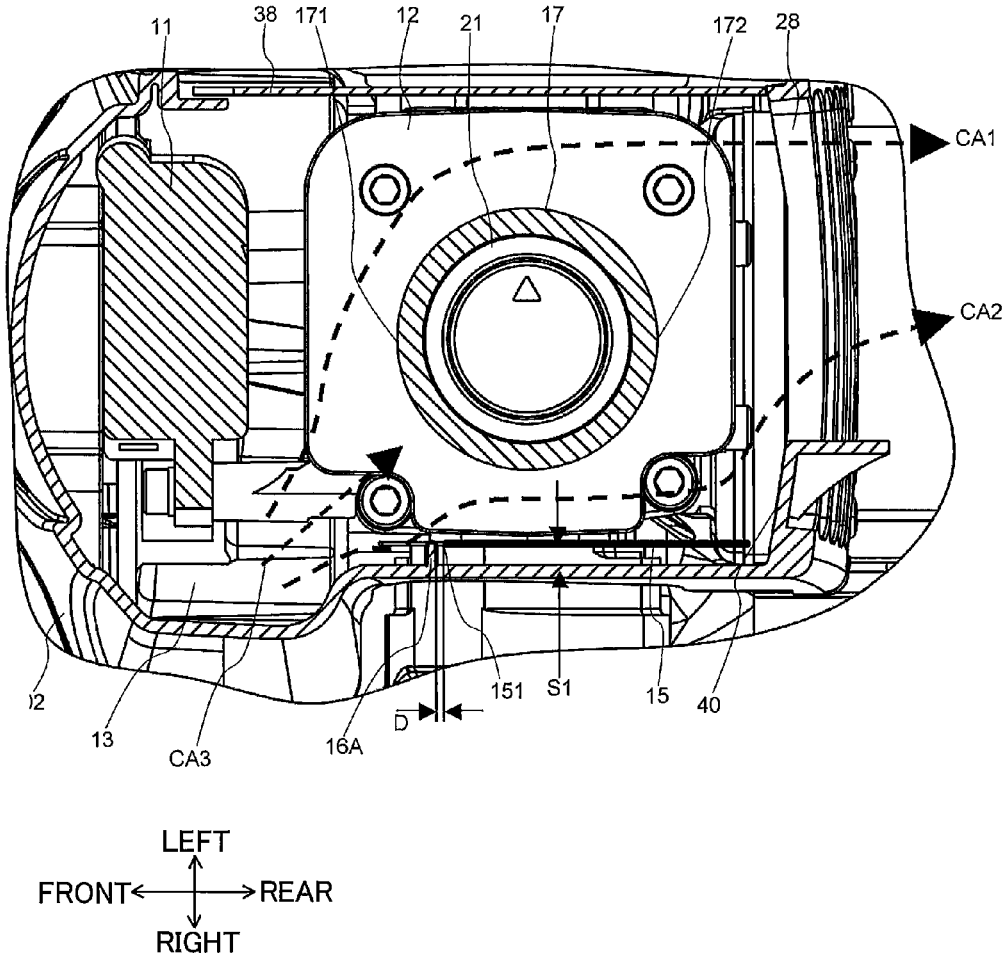
FIG. 5 is a cross-sectional view taken along a line V-V of FIG. 3.

A flow of the cooling air stream CA in a horizontal direction will next be described. FIG. 5 is a cross-sectional view of the cylinder cover 102, the cylinder 1 and its ambient components and taken along a horizontal plane V-V passing between the neighboring fins 12 vertically aligned. Since a void is provided between the neighboring fins 12 at the outer peripheral surface of the cylinder portion 17, the cylinder 1 (cylinder portion 17) can be efficiently cooled by the cooling air stream CA flowing through the void. The cooling air stream CA receives a great amount of influence from the air guide plate 15 and the partition plate 38.

In FIG. 5, the cooling air stream CA (or cooling air stream CA3) supplied from the cooling fan 13 and entered at the front right side of the cylinder 1 (left lower side in FIG. 5) passes along the fins 12 and is impinged on the cylinder portion 17. The cooling air stream CA3 is then bifurcated into a cooling air stream CA1 flowing at left side of the cylinder portion 17 (upper side in FIG. 5) and a cooling air stream CA2 flowing at right side of the cylinder portion 17 (lower side in FIG. 5). The bifurcated air streams CA1, CA2 are finally flowed outside of the cylinder cover 102 through the ventilator window 28.

In this case, particularly high cooling efficiency can be obtained if the cooling air streams CA1 and CA2 flow along and proximity to the cylinder portion 17, and if the cooling to the cylinder portion 17 is achievable from a cooling-fan side end 171 of the cylinder portion 17 to an exhaust side end 172 of the cylinder portion 17. The cooling fan side end 171 of the cylinder portion 17 is a most upstream side of the cylinder portion 17 (front-most portion of the cylinder portion 17 at a diagonally left end of the cylinder portion 17 in FIG. 5) in a flowing direction of the cooling air, and the exhaust side end 172 of the cylinder portion 17 is a most downstream side of the cylinder portion 17 (rear-most portion of the cylinder portion 17 at diagonally right end of the cylinder portion 17 in FIG. 5) in the flowing direction of the cooling air.

As shown in FIG. 5, the partition plate 38 is positioned at the left side of the cylinder portion 17 (upper side in FIG. 5), and extends to a position adjacent to the cooling fan 13 in the frontward/rearward direction. With this structure, the cooling air stream CA1 flowing at left side of the cylinder portion 17 undergoes restriction by the partition plate 38. That is, the cooling air stream CA1 does not flow at the left side of the partition plate 38, but only flows along the vicinity of the cylinder portion 17. Thus, the cooling air stream CA1 can efficiently cool the cylinder 1. In this case, since the partition plate 38 is made from a material having high heat resistivity, degradation of the partition plate 38 does not occur even if the partition plate 38 is positioned adjacent to the cylinder 1 (fins 12). Further, intensive vibration is not generated in the cylinder cover 102, since the partition plate 38 is provided separately from the cylinder cover 102.

In FIG. 5, assuming that the ventilator window 28 largely extends to the right side (to the lower side in FIG. 5), the cooling air stream CA2 may flow along a portion remote from the right side of the cylinder portion 17 at a portion adjacent to the ventilator window 28 (downstream side of the cylinder portion 17). In order to restrict such flow, a guide portion 40 is provided at the cylinder cover 102 so as to interrupt the flow of the cooling air stream CA2 at the right side of the ventilator window 28. Thus, the cooling air stream CA2 can flow in the vicinity of the cylinder portion 17 even at a position adjacent to the ventilator window 28.

Regarding the upstream side of the cylinder portion 17, the flow of cooling air stream CA2 is regulated by the air guide plate 15 positioned at the right side of the cylinder portion 17, in a manner the same as the partition plate 38. Accordingly, the flow of the cooling air stream CA2 at the upstream side of the cylinder portion 17 is subjected to limitation by the air guide plate 15, so that the air flow path can be limited to the portion adjacent to the cylinder portion 17. In this case, similar to the partition plate 38, degradation of the air guide plate 15 does not occur even if the air guide plate 15 is positioned adjacent to the cylinder 1 (or fins 12).

However, if the air guide plate 15 is positioned adjacent to the fins 12, a space (a first small space S1 in FIG. 5) between the right side of the air guide plate 15 and an inner surface of the cylinder cover 102 is enlarged. Therefore, a part of the cooling air stream CA2 may flow through the first small space S1, which does not make contribution for cooling the cylinder 1. Accordingly, the cooling air stream CA2 directing toward the first small space S1 should be restricted, and the cooling air stream CA2 should be directed to the left side of the air guide plate 15 so as to enhance cooling efficiency of the cooling air stream CA2.

To this effect, as show in FIG. 5, an air guide portion 16A is provided to extend from the cylinder cover 102 toward the cylinder 1 so as to shut off an inlet end of the first small space S1 at an upstream side of the cylinder portion 17. The air guide portion 16A is a protrusion protruding from the inner surface of the cylinder cover 102. Direct contact of the air guide portion 16A with the fins 12 which will be heated at high temperature should be avoided, since the air guide portion 16A is integral with the cylinder cover 102 which provides low heat resistivity. To this effect, in FIG. 5, the air guide portion 16A does not protrude leftward beyond the air guide plate 15. Similarly, direct contact of the air guide portion 16A with the air guide plate 15 is not preferable. Therefore, a gap D is provided between the air guide portion 16A and an end portion 151 of the air guide plate 15, the end portion 151 being closest to the cooling fan 13 among any portion of the air guide plate 15, or an upstream end of the air guide plate 15 in the flowing direction of the cooling air stream CA2. The gap D has a width of, for example, from 1 to 2 mm. Because the width of the gap D is parallel to the flowing direction of the cooling air stream CA2, flowing of the cooling air stream CA2 into the first small space S1 through the gap D is unlikely to occur.

Here, if the upstream end 151 of the air guide plate 15 and the air guide portion 16A are positioned upstream of the cylinder portion 17 (leftward of the cylinder portion 17 in FIG. 5), the flow of cooling air stream CA3 directing directly to the cylinder portion 17 is blocked by the upstream end 151 and the air guide portion 16A. To avoid this problem, the upstream end 151 of the air guide plate 15 and the air guide portion 16A are preferably positioned downstream of a cooling-fan side end 171 of the cylinder portion 17.

Figure 6:
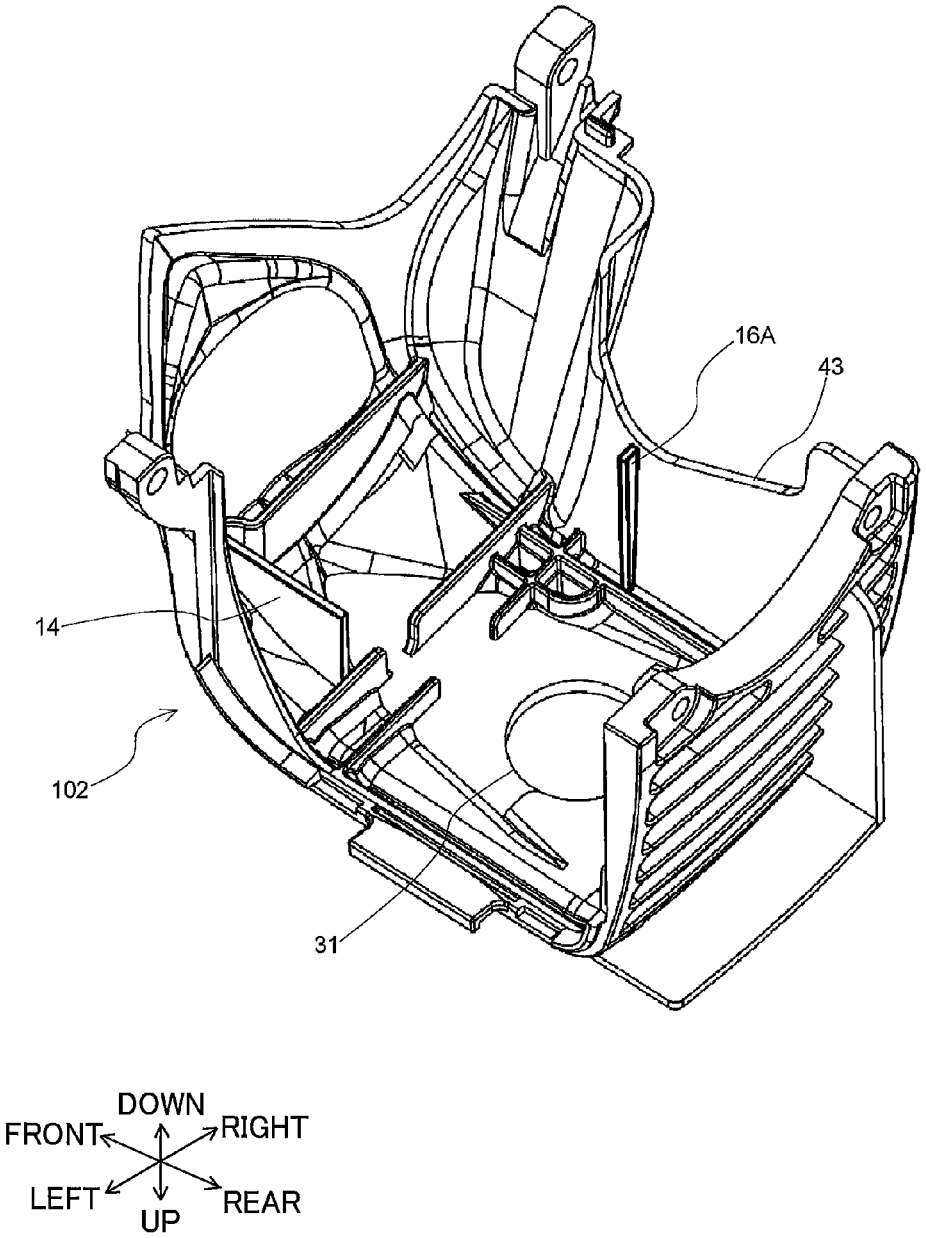
FIG. 6 is a perspective view of a cylinder cover in the air-cooled engine according to the present invention.

FIG. 6 shows an internal structure of the cylinder cover 102 provided with the air guide portion 16A. The first small space S1 extends in the vertical direction in accordance with a shape and size of the air guide plate 15. To this effect, the air guide portion 16A is elongated over a vertical length of the first small space S1 so as to block (cover) the first small space S1 in the inner side of the cylinder cover 102. The cylinder cover 102 and the air guide portion 16A are molded integrally with each other with a resin material. Incidentally, in FIG. 6, a notched portion 43 is formed at a position corresponding to the intake tube 7, and a plug cap attachment hole 31 is formed at a position corresponding to the ignition plug 2.

As described above, enhanced cooling efficiency to the cylinder 1 can be obtained in the cylinder cover 102 along with the air guide portion 16A in combination with the air guide plate 15.

Further, cooling efficiency to the cylinder 1 can also be enhanced by shutting off the cooling air flow which does not make contribution for cooling the cylinder 1 in a manner different from that of the foregoing embodiment as described below.

Figure 7:
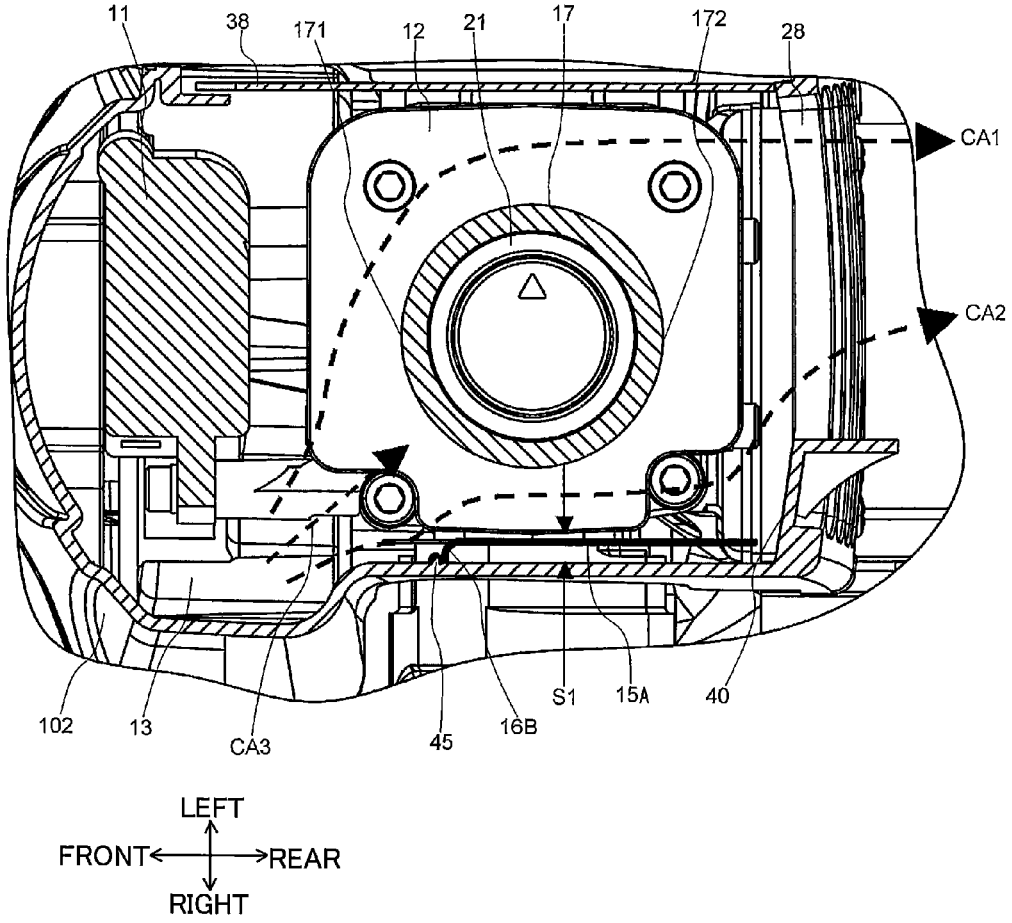
FIG. 7 is a cross-sectional view similar to FIG. 5 of an air-cooled engine according to a first modification.

FIG. 7 shows a first modification to the above-described embodiment particularly shown in FIG. 5. According to the first modification, instead of the air guide portion 16A provided in the foregoing embodiment, a small rib-like protrusion 45 whose protruding length is smaller than that of the air guide portion 16A is provided at a position identical to the position at which the air guide plate 16A is provided. Further, the air guide plate 15 and the partition plate 38 in the foregoing embodiment are plate like shaped. In contrast, an air guide plate 15A in the first modification has an upstream end portion provided with an air guide portion 16B curved rightward, i.e., curved toward the inner surface of the cylinder cover 102.

Accordingly, the protrusion 45 and the air guide portion 16B can restrain the cooling air stream CA2 from flowing into the first small space S1. The protrusion 45 is integrally formed with the cylinder cover 102 similar to the air guide portion 16A. However, the left-right size of the protrusion 45 is smaller than that of the air guide portion 16A, and therefore, only the protrusion 45 by itself cannot restrain the cooling air stream CA2 from flowing into the first small space S1. Thus, the curved air guide portion 16B of the air guide plate 15A can restrain the cooling air stream CA2 from flowing through the first small space S1. In the illustrated first modification, the air guide portion 16B is engaged with the protrusion 45 for position fixing.

By using a part of the air guide plate 15A as the air guide portion 16B, flowing of the cooling air stream CA2 into the first small space S1 can be restrained to enhance cooling efficiency. According to the first modification, the air guide plate 15A which will be heated at high temperature is in contact with the cylinder cover 102, which is different from the structure in the foregoing embodiment. However, contact between the air guide plate 15A and the cylinder cover 102 only occurs at the endmost portion of the air guide plate 15A, and the area of such contact is extremely small. Thus, the contact does not lead to meltdown accident of the cylinder cover 102.

Incidentally, according to the first modification, the small protrusion 45 is provided at the cylinder cover 102. However, the cylinder cover 102 can be arbitrarily shaped as long as the air guide portion 16B can be stably engaged and held. For example, instead of the protrusion 45, a recessed portion is available with which the air guide portion 16B is engaged.

Further, as described above, since the air guide plate 15 (15A) also serves as the gasket between the intake port 5 and the intake tube 7, the air guide plate 15 (15A) is formed of a sealing member having a moderate flexibility. In such a case, it is difficult to produce the air guide plate 15A having the curved air guide portion 16B only with such sealing member. To this effect, the air guide plate 15A can be formed of a multi-layer structure including such sealing member and a sheet of metal.

Figure 8:
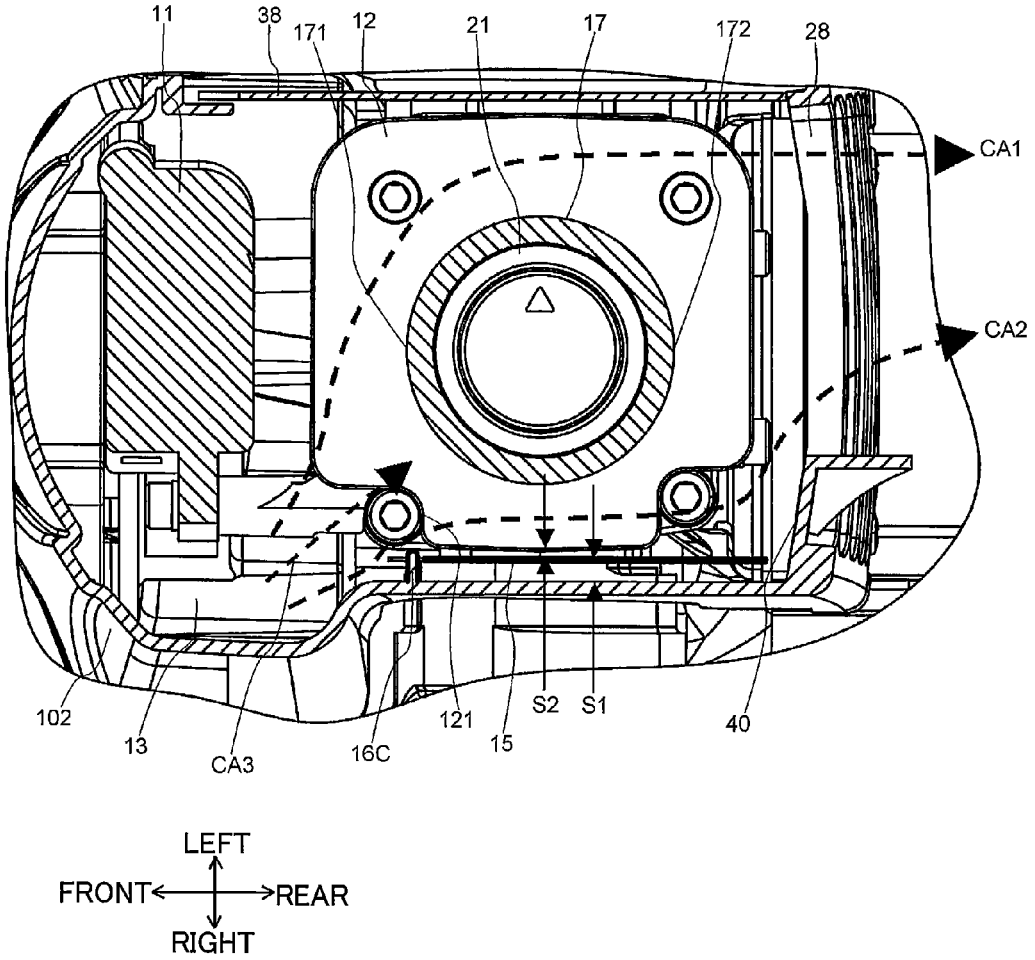
FIG. 8 is a cross-sectional view similar to FIG. 5 of an air-cooled engine according to a second modification.

FIG. 8 shows a cross-sectional view according to a second modification and corresponds to the cross-section of FIG. 5. According to the second modification, restriction of flow of cooling air is attained with respect to the first small space S1 and to a broad region outside of the fins 12, and instead, amount of cooling air stream CA2 flowing between the neighboring fins 12 is increased. To this effect, instead of the air guide portion 16A in the depicted embodiment, an air guide portion 16C having a projecting length greater than that of the air guide portion 16A is provided in the cylinder cover 102 at a limited position thereof.

As described above, the cooling air stream CA2 flows at the left side region of the air guide plate 15. In FIG. 8, the left side region is zoned into a fin region and a second small space S2. The fin region is a region between the neighboring fins 12 (in FIG. 8, the fin region is outside of the cylinder portion 17 and overlapped with the fin 12), and the second small space S2 is a region between outer peripheral edges of the fins 12 and the air guide plate 15. Here, the cooling air stream CA2 flowing through the fin region is utmost contributory for cooling the cylinder 1. To this effect, in the second modification, the air guide portion 16C has a major length extending in a direction perpendicular to the flowing direction of the cooling air stream CA2 in order to restrain the cooling air stream CA2 from flowing into the second small space S2, so that the almost all the cooling air stream CA2 can be directed into the fin region (adjacent to the cylinder portion 17).

Similar to the foregoing embodiment, the air guide portion 16C is provided at the cylinder cover 102, and is spaced away from the fins 12. In this connection as shown in FIG. 8, the air guide portion 16C is positioned at a space provided by a notched portion 121 of the fin 12. Generally, in the cylinder 1, a cylinder head is fixed to a cylinder block by bolts, and attachment and detachment of the bolts are required for assembly and disassembly of the cylinder 1. The notched portion 121 is formed for providing a space corresponding to the position of the bolt, otherwise attachment and detachment work cannot be performed. According to the second modification, the space provided by the notched portion 121 can be used for positioning the air guide portion 16C. Because of the sufficient notched space, direct contact of the air guide portion 16C with the fins 12 can be avoided in spite of the elongated structure of the air guide portion 16C which covers the second small space S2. Incidentally, the air guide plate 15 can be elongated such that an upstream end portion of the air guide plate 15 in the flowing direction of the cooling air stream CA2 is positioned adjacent to the air guide portion 16C.

According to the second modification, the notched portion 121 of the fin 12 is utilized for positioning the air guide portion 16C in order to enhance cooling efficiency to the cylinder 1.

Various modifications are conceivable.

For example, the air guide plate 15A of the first modification shown in FIG. 7 can have another curved portion curved toward the cylinder 1 as well as the air guide portion 16B curved toward the cylinder cover 102 so as to provide the function the same as that of the second modification.

In the above describe embodiment and modifications, the first small space S1 is defined to extend vertically in accordance with a shape and size of the air guide plate 15, 15A. However, complete coverage of the first small space S1 by the air guide portion 16A, 16B, 16C is not required, but partial coverage is sufficient for enhancing cooling efficiency to the cylinder 1. Further, the second small space S2 is defined to extend vertically by the fins 12 and the air guide plate 15. Here, similar to the first small space S1, complete coverage of the second small space S2 by the air guide portion 16C is not required, but partial coverage is sufficient for enhancing cooling efficiency to the cylinder 1.

Further, in the above describe embodiment and modifications, the first small space S1 is fully covered by the air guide portion 16A, 16B, 16C at the upstream side of the air guide plate 15, 15A in an axial direction of the drive shaft 23. However, apparently, a given advantage can be obtained even by partial coverage of the first small space S1 by the air guide portion 16A, 16B, 16C at the upstream side of the air guide plate 15, 15A in the axial direction of the drive shaft 23. That is, all that is required is that the air guide portion 16A, 16B, 16C at least partly covering the first small space S1 at the upstream side of the air guide plate 15, 15A in the axial direction of the drive shaft 23.

In other words, it is apparent that enhancement of cooling efficiency can be realized as long as the amount of the cooling air stream CA2 flowing into the first small space S1 can be decreased. Thus, configuration of the air guide portion can be arbitrarily designed as long as the designed guide portion can provide such cooling effect.

Further, in the above-described embodiment and modifications, the gasket provided between the intake port 5 and the intake tube 7 is compatible as the air guide plate 15, 15A. However, an air guide plate independent of a gasket can be used for regulating the cooling air stream CA2 in the cylinder cover 102.

Further, in the above-described embodiment and modifications, a cooling air inlet is positioned at the right side of the cylinder cover 102, and the air guide plate 15, 15A is positioned at a closer side (right side) of the cooling air inlet, while the partition plate 38 is positioned at a remote side (left side) of the cooling air inlet. Further, the air guide portion 16A, 16B, 16C is provided at a side the same as the air guide plate 15, 15A. However, positions of the air guide plate and the air guide portion can be altered so as to enhance cooling efficiency depending on a position of the cooling air inlet with respect to the cylinder cover 102. For example, the air guide plate and the air guide portion may be provided at both right side and left side of the cylinder cover 102.

Further, the air-cooled engine 100 described above is characterized by an internal structure of the cylinder cover 102. Therefore, the above-described engine 100 can be installed in a conventional main body of an engine-operated work tool. Accordingly, the air-cooled engine 100 described above is available for any kind of engine-operated work tool equipped with the compact air-cooled engine requiring the cylinder cover.

While the invention has been described in detail with reference to the above-described embodiments thereof, it would be apparent to those skilled in the art that various changes and modifications may be made therein without departing from the scope of the invention.

What is claimed is:

1. An air-cooled engine comprising:

an engine body provided with a cylinder having a cylinder portion and a plurality of cooling fins provided at an outer peripheral surface of the cylinder portion, and a drive shaft provided with a cooling fan, the drive shaft defining an axis extending in an axial direction;

a cylinder cover covering the cylinder, the cooling fan being configured to generate cooling air stream within the cylinder cover for cooling the cylinder;

an air guide plate provided at an internal space of the cylinder cover and between an inner surface of the cylinder cover and the plurality of fins, the air guide plate extending across outer edges of the plurality of cooling fins to cover the plurality of cooling fins, the air guide plate extending along the inner surface of the cylinder cover to define a first small space therebetween; and a restricting portion provided in the internal space of the cylinder cover and extending in a direction crossing the air guide plate, the restricting portion being configured to cover at least a part of the first small space at an upstream side of the air guide plate in the axial direction of the drive shaft to restrict the cooling air stream from entering into the first small space.

2. The air-cooled engine as claimed in claim 1, wherein the restricting portion is configured to fully cover the first small space at the upstream side of the air guide plate in the axial direction of the drive shaft.

3. The air-cooled engine as claimed in claim 1, wherein the restricting portion is positioned to be spaced away from an upstream end of the air guide plate by a length ranging from 1 mm to 2 mm in the axial direction of the drive shaft.

4. The air-cooled engine as claimed in claim 1, wherein the restricting portion protrudes from the inner surface of the cylinder cover toward the cylinder.

5. The air-cooled engine as claimed in claim 1, wherein the restricting portion is positioned downstream of an upstream end portion of the cylinder in the axial direction of the drive shaft.

6. The air-cooled engine as claimed in claim 1, wherein the air guide plate and the outer edges of the plurality of cooling fins define a second small space therebetween; and wherein the restricting portion covers the second small space at the upstream side of the air guide plate in the axial direction of the drive shaft.

7. The air-cooled engine as claimed in claim 6, wherein the restricting portion entirely covers the second small space at the upstream side of the air guide plate in the axial direction of the drive shaft.

8. The air-cooled engine as claimed in claim 1, wherein the restricting portion is provided at the inner surface of the cylinder cover.

9. The air-cooled engine as claimed in claim 8, wherein the restricting portion is integral with the cylinder cover.

10. The air-cooled engine as claimed in claim 1, wherein the restricting portion constitutes a part of the air guide plate.

11. The air-cooled engine as claimed in claim 1, wherein the inner surface of the cylinder cover has a protrusion protruding toward the cylinder; and wherein the restricting portion constitutes a part of the air guide plate and is engaged with the protrusion.

12. An engine-operated work tool comprising:

a casing and;

an air-cooled engine accommodated in the casing and comprising:

an engine body provided with a cylinder having a cylinder portion and a plurality of cooling fins provided at an outer peripheral surface of the cylinder portion, and a drive shaft provided with a cooling fan, the drive shaft defining an axis extending in an axial direction;

a cylinder cover covering the cylinder, the cooling fan being configured to generate cooling air stream within the cylinder cover for cooling the cylinder;

an air guide plate provided at an internal space of the cylinder cover and between an inner surface of the cylinder cover and the plurality of fins, the air guide plate extending across outer edges of the plurality of cooling fins to cover the plurality of cooling fins, the air guide plate extending along the inner surface of the cylinder cover to define a first small space therebetween; and a restricting portion provided in the internal space of the cylinder cover and extending in a direction crossing the air guide plate, the restricting portion being configured to cover at least a part of the first small space at an upstream side of the air guide plate in the axial direction of the drive shaft to restrict the cooling air stream from entering into the first small space.

* * * * *